US011657742B1

(12) United States Patent
Akyol et al.

(10) Patent No.: US 11,657,742 B1
(45) Date of Patent: May 23, 2023

(54) CIRCUITRY FOR SCREENING DEFECTIVE PORTION OF DISPLAY CHIP

(71) Applicant: Apple Inc., Cupertino, CA (US)

(72) Inventors: Hasan Akyol, Mountain View, CA (US); Chung-Lun Edwin Hsu, San Jose, CA (US); Baris Cagdaser, Sunnyvale, CA (US); John T. Wetherell, San Jose, CA (US); Xuebei Yang, Fremont, CA (US); Ali Tabatabaei, San Francisco, CA (US); Patrick Bryce Bennett, San Leandro, CA (US); Yingkan Lin, San Jose, CA (US); Chun-Ming Tang, San Jose, CA (US); Xiaofeng Wang, San Jose, CA (US); Hopil Bae, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/399,974

(22) Filed: Aug. 11, 2021

Related U.S. Application Data

(60) Provisional application No. 63/076,849, filed on Sep. 10, 2020.

(51) Int. Cl.
*G09G 3/00* (2006.01)
*G09G 3/3258* (2016.01)
*G09G 3/3275* (2016.01)

(52) U.S. Cl.
CPC ..... *G09G 3/006* (2013.01); *G09G 3/3258* (2013.01); *G09G 3/3275* (2013.01); *G09G 2320/04* (2013.01); *G09G 2330/12* (2013.01)

(58) Field of Classification Search
CPC ..... G09G 3/006; G09G 3/3233; G09G 2310/0297; G09G 2330/08; G09G 2330/10; G09G 2330/12
See application file for complete search history.

(56) References Cited

U.S. PATENT DOCUMENTS

| | | | | |
|---|---|---|---|---|
| 10,971,095 | B2 * | 4/2021 | Suzuki | G02F 1/136286 |
| 2010/0188320 | A1 * | 7/2010 | Min | G09G 3/3291 345/80 |
| 2013/0179745 | A1 * | 7/2013 | Huang | G01R 31/31924 714/E11.155 |
| 2019/0197930 | A1 | 6/2019 | Jung et al. | |
| 2021/0264839 | A1 * | 8/2021 | Furukawa | G09G 3/2003 |

FOREIGN PATENT DOCUMENTS

WO 2019225955 A1 11/2019

OTHER PUBLICATIONS

International Search Report & Written Opinion for PCT Patent Application No. PCT/US2021/049122 dated Nov. 24, 2021; 13 pgs.

* cited by examiner

*Primary Examiner* — Sardis F Azongha
(74) *Attorney, Agent, or Firm* — Fletcher Yoder, P.C.

(57) ABSTRACT

Embodiments disclosed herein provide systems and methods for testing and repairing various aspects of an electronic display. The electronic display includes a reference array and an active array. The electronic display also includes test circuitry used to test individual or any combination of pixels of the electronic display. Switches may be disposed between the pixels and the test circuitry to be to repair the various components of the electronic display.

20 Claims, 14 Drawing Sheets

CIRCUITRY FOR SCREENING DEFECTIVE PORTION OF DISPLAY CHIP

CROSS-REFERENCE TO RELATED APPLICATIONS

This application claims the benefit of U.S. Provisional Application No. 63/076,849, filed Sep. 10, 2020, and entitled "CIRCUITRY FOR SCREENING DEFECTIVE PORTION OF DISPLAY CHIP," which is incorporated herein by reference in its entirety for all purposes.

SUMMARY

The present disclosure generally relates to electronic displays and, more particularly, to testing and correcting voltage degradation in an electronic display with voltage-driven and/or current-driven pixels.

Flat panel displays, such as light-emitting diode (LED) displays or organic-LED (OLED) displays, are commonly used in a wide variety of electronic devices, including such consumer electronics such as televisions, computers, and handheld devices (e.g., cellular telephones, audio and video players, gaming systems, and so forth). Such display panels typically provide a flat display in a relatively thin package that is suitable for use in a variety of electronic goods. In addition, such devices may use less power than comparable display technologies, making them suitable for use in battery-powered devices or in other contexts where it is desirable to minimize power usage.

LED displays typically include picture elements (e.g., pixels) arranged in a matrix to display an image that may be viewed by a user. Individual pixels of an LED display may generate light as current is applied to each pixel. Current may be applied to each pixel by programming a voltage to the pixel that is converted by circuitry of the pixel into the current. The circuitry of the pixel that converts the voltage into the current may include, for example, thin film transistors (TFTs). However, certain operating conditions, such as aging or temperature, may affect the amount of current applied to a pixel when applying a certain voltage.

Similarly, components providing the current to the pixel, such as a source driver, may fail for various reasons. In that case, no current may be provided to a corresponding pixel. Conventionally, a test electrode coupled to each source driver is connected to an external test circuit to identify the failed component. This approach takes a significant amount of time to connect to and test each component. Further, the additional test electrodes and corresponding data lines use a significant amount of space on the integrated circuit of the display leaving a small amount of space for additional pixels that can be used to increase a resolution of the display.

Display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. For example, a pixel emits an amount of light, gamma, or gray level based at least in part on an amount of current supplied to a diode (e.g., an LED) of the pixel. For voltage-driven pixels, a target voltage may be applied to the pixel to cause a target current to be applied to the diode (e.g., as expressed by a current-voltage relationship or curve) to emit a target gamma value. Variations may affect a pixel by, for example, changing the resulting current that is applied to the diode when applying the target voltage. Without appropriate compensation, these variations could produce undesirable visual artifacts.

Accordingly, the techniques and systems described below may be used to test and compensate for functionality of various components of the display. Testing circuitry is coupled to each pixel of the display. The testing circuitry may compensate for one or more components of the display that malfunction (e.g., are broken). The testing circuitry may determine a current through circuitry of each pixel of the display to confirm operation of each pixel and corresponding components.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings described below.

DETAILED DESCRIPTION OF SPECIFIC EMBODIMENTS

Figure 1:
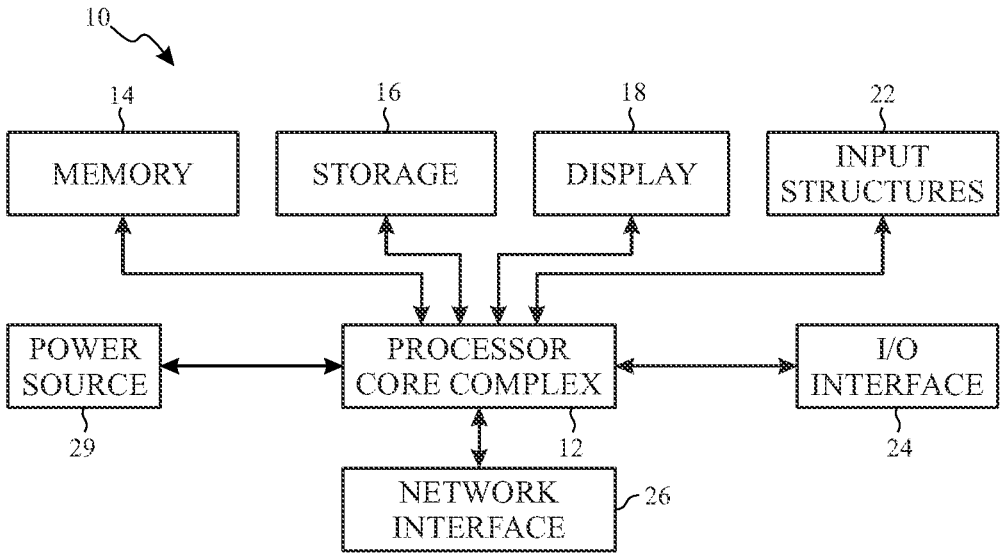
FIG. 1 is a block diagram of an electronic device, according to an embodiment of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based at least in part on the image data. By programming different pixels with different image data, graphical content including images, videos, and text can be displayed.

Display panel sensing allows for operational properties of pixels of an electronic display to be identified to improve the performance of the electronic display. For example, variations in temperature and pixel aging (among other things) across the electronic display cause pixels in different locations on the display to behave differently. Indeed, the same image data programmed on different pixels of the display could appear to be different due to the variations in temperature and pixel aging. For example, a pixel emits an amount of light, gamma, or gray level based at least in part on an amount of current supplied to a diode (e.g., an LED) of the pixel. For voltage-driven pixels, a target voltage may be applied to the pixel to cause a target current to be applied to the diode (e.g., as expressed by a current-voltage relationship or curve) to emit a target gamma value. Variations may affect a pixel by, for example, changing the resulting current that is applied to the diode when applying the target voltage. Without appropriate compensation, these variations could produce undesirable visual artifacts.

Accordingly, the techniques and systems described below may be used to test and compensate for functionality of various components of the display. Testing circuitry is coupled to each pixel of the display. The testing circuitry may compensate for one or more components of the display that malfunction (e.g., are broken). The testing circuitry may determine a current through circuitry of each pixel of the display to confirm operation of each pixel and corresponding components.

Figure 2:
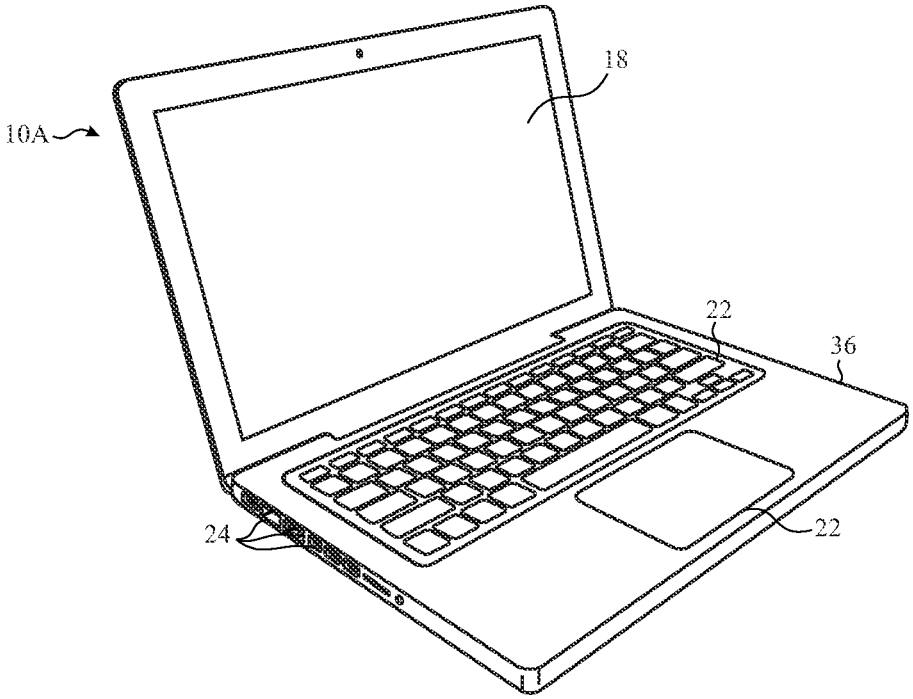
FIG. 2 is a perspective view of a notebook computer representing an embodiment of the electronic device of FIG. 1.
Figure 4:
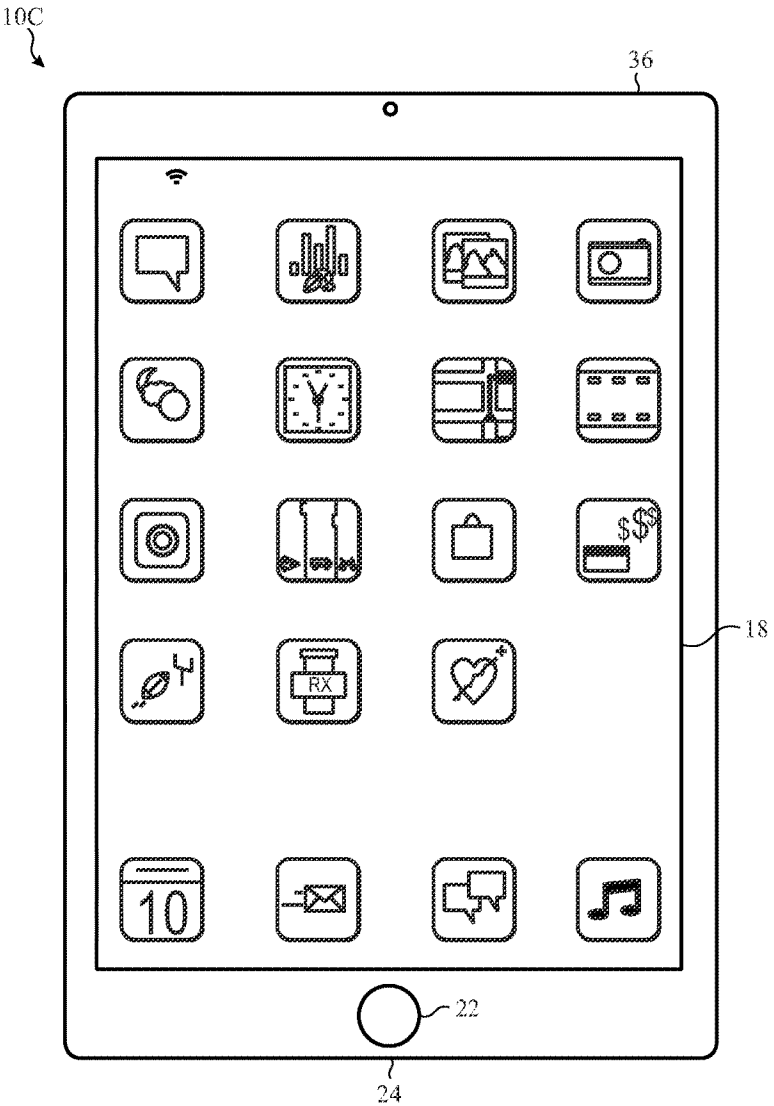
FIG. 4 is a front view of another handheld device representing another embodiment of the electronic device of FIG. 1.
Figure 3:
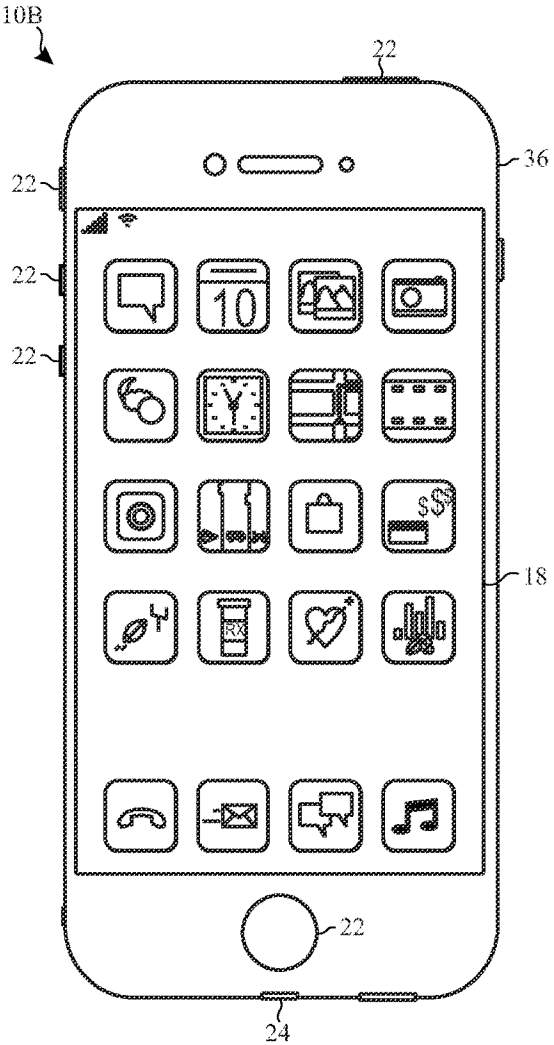
FIG. 3 is a front view of a handheld device representing another embodiment of the electronic device of FIG. 1.
Figure 5:
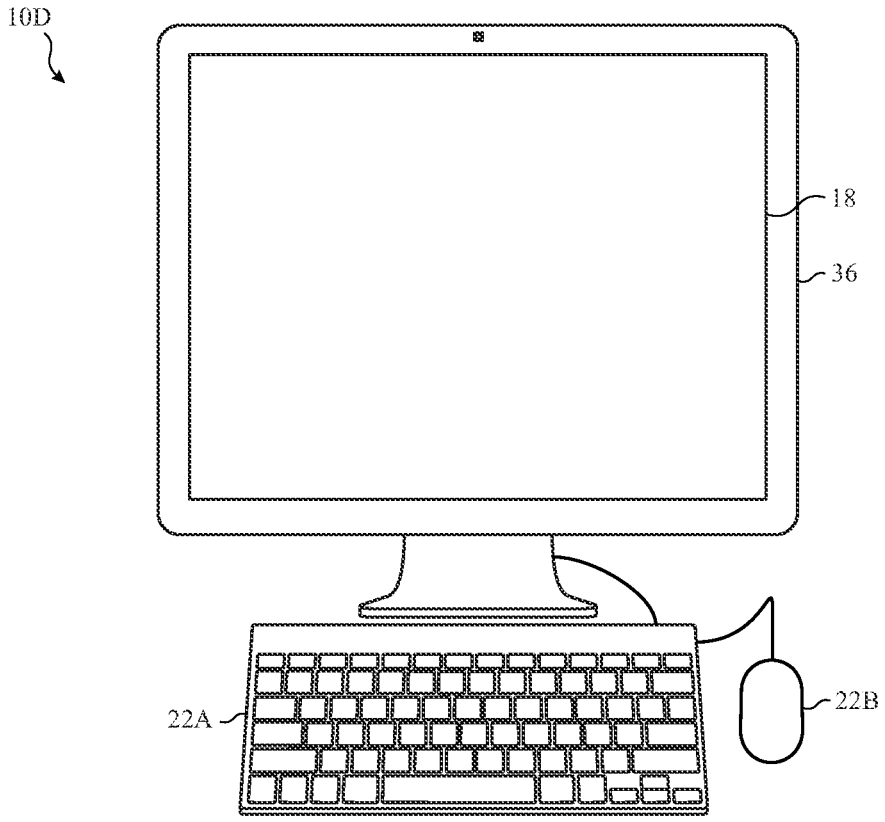
FIG. 5 is a front view of a desktop computer representing another embodiment of the electronic device of FIG. 1.
Figure 6:
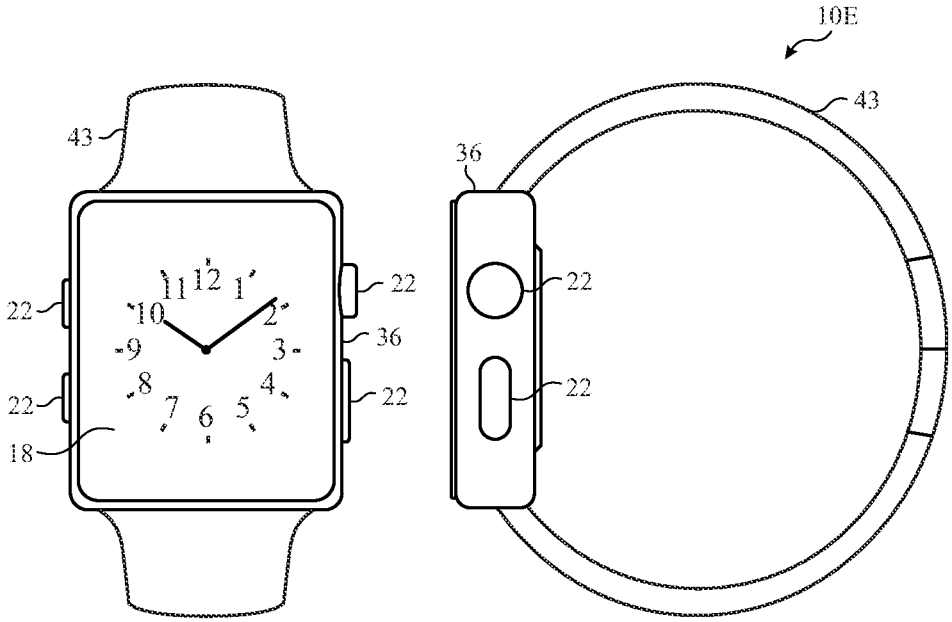
FIG. 6 is a perspective view of a wearable electronic device representing another embodiment of the electronic device of FIG. 1.

With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 29. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and using the feedback to repair a detected defect in the circuitry of the electronic display 18 and/or adjust image data to be displayed on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, a micro-LED display, a micro-OLED type display, or a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 29 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. of Cupertino, Calif. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may be operated using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
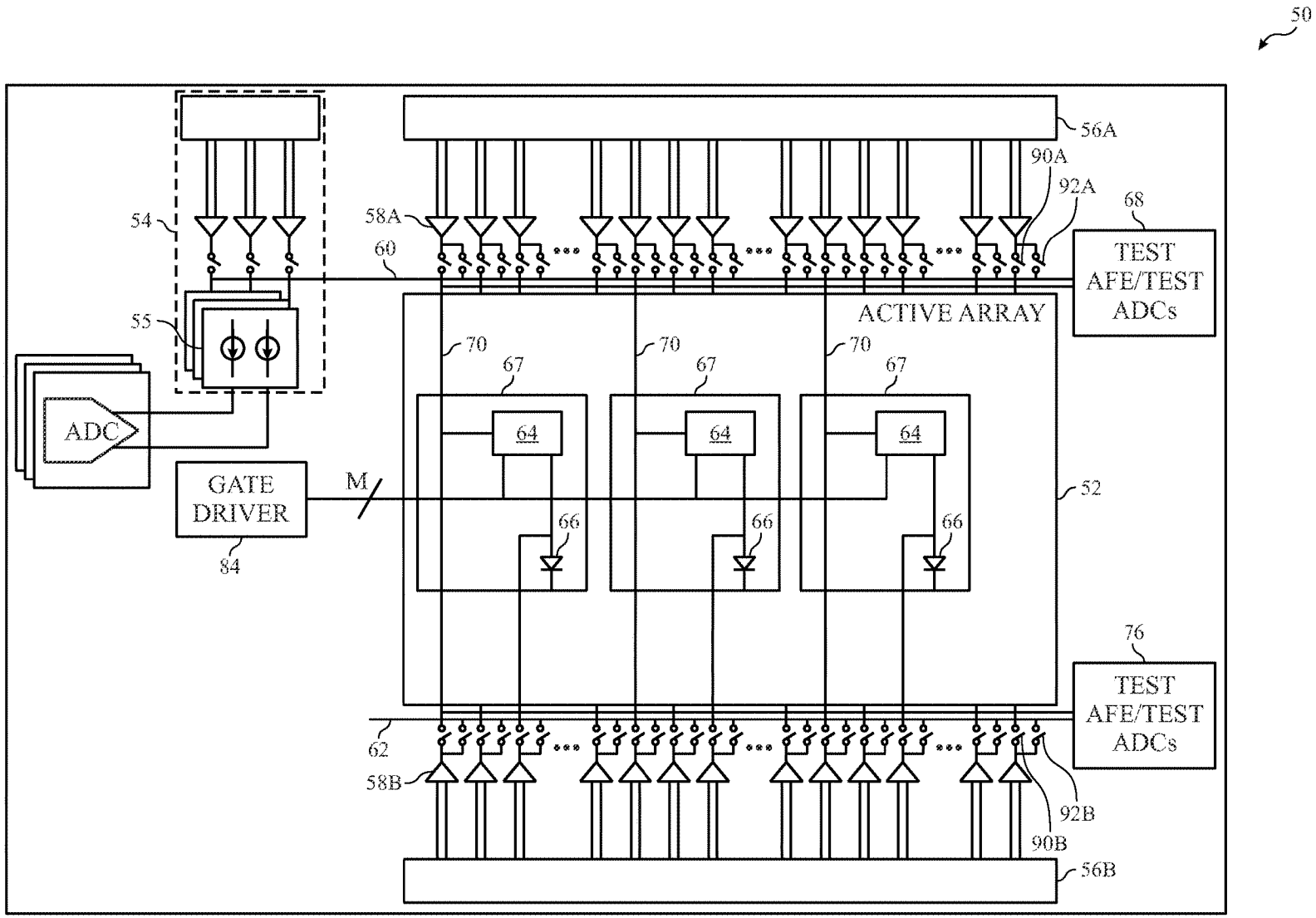
FIG. 7 is a block diagram of a system for display sensing and testing, according to an embodiment of the present disclosure.

FIG. 7 is a block diagram of a system 50 for display sensing and testing, according to an embodiment of the present disclosure. The system 50 may be included in the display 18 of the electronic device 10 discussed with respect to FIG. 1. The system 50 includes an active array 52 and a reference array 54. The reference array 54 includes a number of reference pixels 55. The reference array 54 may be used to test and track an operation of the reference pixels 55, each of which may correspond to one or more pixels 67 of the active array 52. As illustrated, the pixels 67 of the active array 52 may include pixel circuitry 64 and a light emitting diode such as a micro-LED, a micro-OLED, or an organic light-emitting diode (OLED) 66. Based on the operation of the reference pixels 55, one or more parameters (e.g., a current, an output luminance, etc.) of the corresponding pixels 67 of the active array 52 may be adjusted. The pixel circuitry 64 of the pixel 67 may be tested with or without the OLEDs 66 installed in the active array 52. This may allow the circuitry of the active array 52 to be tested to ensure proper operation before the OLEDs 66 are installed.

The active array 52 includes a number of pixels 67 arranged in a matrix. The processor core complex 12, discussed with respect to FIG. 1, may provide image data to the pixels 67 via driver circuitry such as one or more source drivers 58A, 58B and one or more gate drivers 84. The one or more source drivers 58A, 58B and the one or more gate drivers 84 may be coupled to a respective pixel 67 via pixel circuitry 64 to activate or illuminate an OLED 66 based on image data. In some embodiments, the one or more gate drivers 84 may also provide reset, on-bias stress, and/or pixel activation signals to the pixels 67, to prepare the pixels 67 to receive data via the source drivers 58A, 58B. A source latch 56A, 56B is coupled to each of the source drivers 58A, 58B. The source latch 56A, 56B may provide image data to each of the source drivers 58A, 58B to activate/illuminate each pixel 67.

Each source driver 58A, 58B may couple to a test bus 60, 62 via a respective test switch 92A, 92B to provide a signal to test circuitry 68, 76. The test circuitry 68, 76 may include an analog front end (AFE) and/or an analog to digital converter (ADC). That is, an analog signal may be received by the test circuitry 68, 76 via the test bus and converted by the ADC for testing. During normal operation of the system 50, a state of the test switches 92A, 92B are open such that the source drivers 58A, 58B are decoupled from the test bus 60, 62. During testing of the source drivers 58A, 58B, a state of the test switches 92A, 92B may be changed to closed such that the source drivers 58A, 58B are coupled to the test bus 60, 62. The test switches 92A, 92B enable testing of one, all, or some combination of the source drivers 58A, 58B simultaneously.

Thus, the test switches 92A, 92B enable isolation of one or more source drivers 58A, 58B to be tested. In some embodiments, a data switch 90A, 90B may be disposed between and coupled to the source drivers 58A, 58B and the pixel circuitries 64. During normal operation, the data switches 90A, 90B may be in a closed state such that the source drivers 58A, 58B are coupled to the pixel circuitry 64 of the pixels 67. During a testing operation, the data switches 90A, 90B may be in an opened state.

The test buses 60, 62 are coupled to the test circuitry 68, 76. The signal provided to the test circuitry 68, 76 by the source drivers 58A, 58B may be a voltage or current that would otherwise be provided to respective pixel circuitry 64. The test circuitry 68, 76 may include various components, such as, for example, multiplexers and/or switches, to receive one or more signals from the source drivers 58A, 58B, the gate drivers 84, the pixel circuitry 64, data lines 70 between the source drivers 58A, 58B and the pixel circuitry 64, and the like. For each pixel 67, the test circuitry 68, 76 may determine whether a defect exists in a respective source driver 58A, 58B, a respective gate driver 84, a respective pixel circuitry 64, a data line between the respective source driver 58A, 58B and the respective pixel circuitry 64, and the like based at least in part on the one or more signals. The various components of the test circuitry 68, 76 are discussed in more detail with respect to FIGS. 8-19 below.

Figure 8:
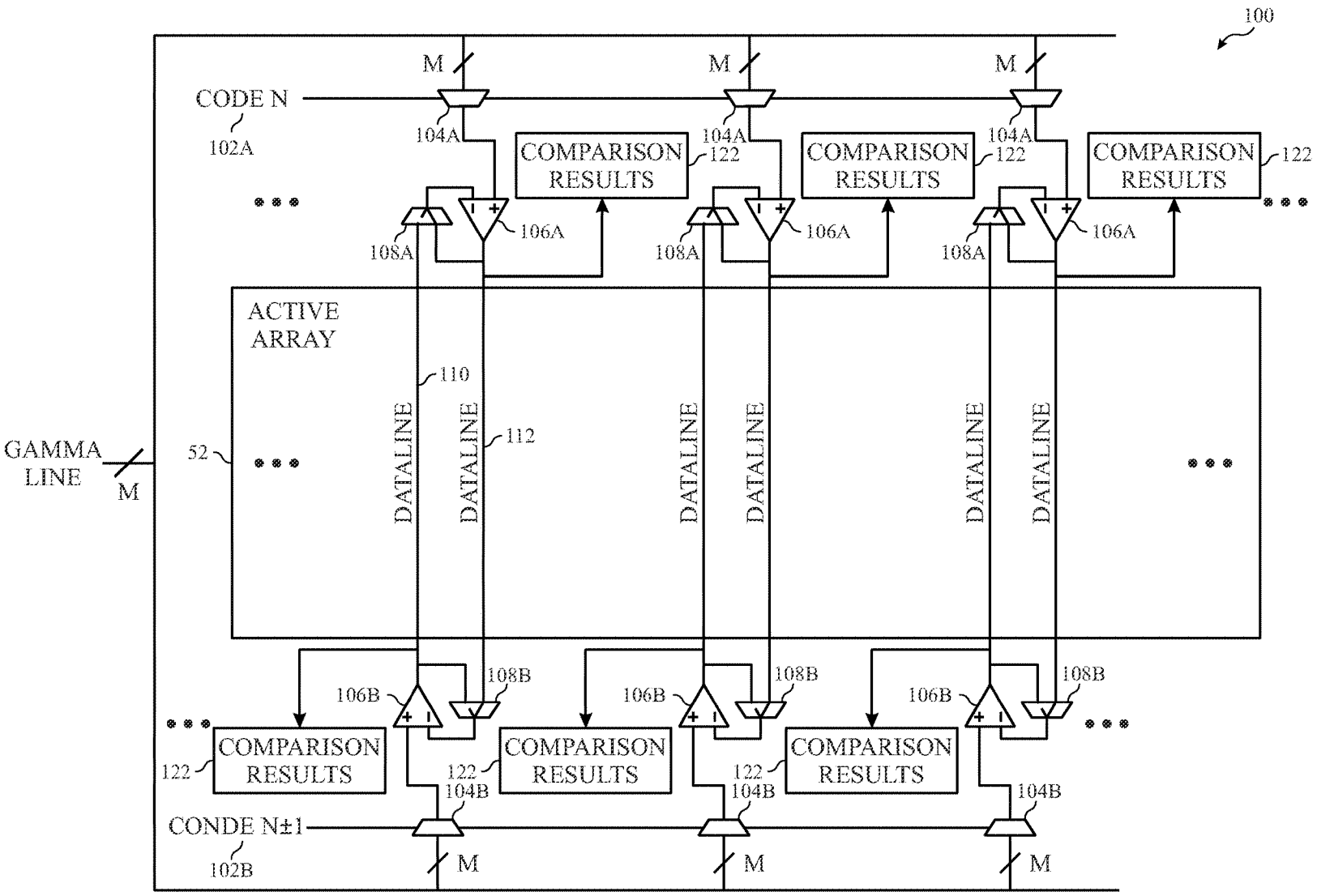
FIG. 8 is a block diagram of an example architecture for screening source drivers of a display, according to an embodiment of the present disclosure.

FIG. 8 is a block diagram of an example architecture 100 for screening source drivers of a display, according to an embodiment of the present disclosure. The architecture 100 includes a number of source drivers 106A, 106B coupled to a number of multiplexers 104A, 104B, 108A, 108B. In some embodiments, the source driver 106A, 106B may correspond to the source drivers 58A, 58B, respectively, discussed with respect to FIG. 7.

An input signal (e.g., gamma) is provided to the source drivers 106A, 106B via the multiplexers 104A, 104B. The multiplexers 104A provide the input signal to the first source drivers 106A and the multiplexers 104B provide the input signal to the second source drivers 106B, based on respective code lines 102A, 102B. In some embodiments, first multiplexers 108A and second multiplexers 108B are switches that route an output of at least some of the pluralities of source drivers 106A, 106B to a corresponding opposite source driver 106B or 106A.

To test a number of first source drivers 106A and corresponding data lines 112, a corresponding number of second source drivers 106B may function as voltage comparators. Respective first multiplexers 108A are switched such that outputs from respective second source drivers 106B are provided to a controller 122. For example, the second source drivers 106B may be coupled to receive the input signal and coupled to respective data lines 112 of the first source drivers 106A. In that case, the first multiplexers 108A may provide feedback to the first source drivers 106A from the data line 112. The second source drivers 106B may receive and compare the input signal from the multiplexers 104B and a signal from the first source drivers 106A via the data line 112. The second source drivers 106B provide a comparison result to the controller 122. The comparison by the second multiplexers 108B may be performed for each of the first source drivers 106A regardless of whether the input signal is received. That is, the comparison may be performed to ensure the input signal is provided to the data line 112 and/or to ensure the data line 112 is not shorted.

A similar configuration may be used to test the second source drivers 106B and corresponding data lines 110. In that case, the second multiplexers 108B may provide feedback to the second source drivers 106B. The first multiplexers 108A may receive and compare the input signal from the multiplexers 104A and a signal from the second source drivers 106B via the data line 110. The first source drivers 106A provide the comparison result to the controller 122.

Although not shown, the data lines 110, 112 may be coupled to one or more pixels of the display 18, such as the pixels 67 discussed with respect to FIG. 7. That is, the architecture 100 may be used to test the source drivers 106A, 106B with or without the pixels installed in the display. In this way, the architecture 100 can be tested during manufacturing which reduces downtime to correct an issue with the source drivers 106A, 106B and the data lines 110, 112. Testing before the pixels are installed in the display 18 can also reduce voltage degradation of the pixels 67 during testing.

Testing via source drivers opposite the source drivers being tested reduces a time to test the source drivers (and respective data lines) by testing the source drivers simultaneously. Further, the pluralities of first and second multiplexers 108A, 108B enable testing of the source drivers with minimal components added to the architecture 100 of the display. That is, for example, some existing circuitry of a display panel is utilized for the testing without significantly increasing a size of the existing architecture.

Figure 9:
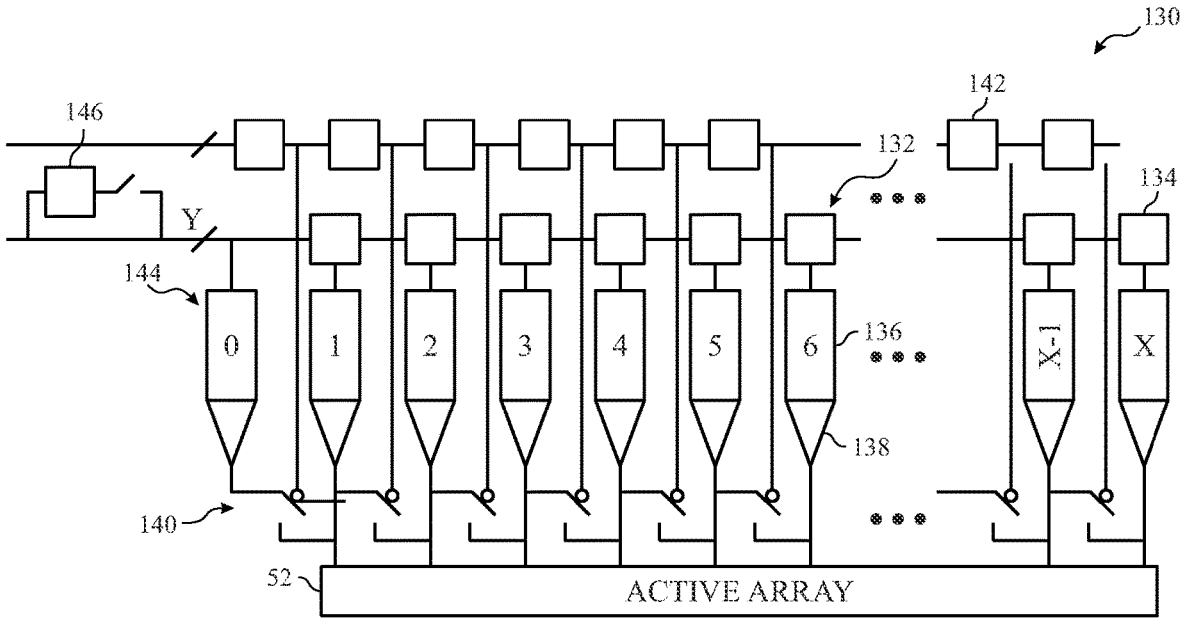
FIG. 9 is a block diagram of an example architecture for repairing a source driver, according to an embodiment of the present disclosure.

FIG. 9 is a block diagram of an example architecture 130 for repairing a source driver 132, according to an embodiment of the present disclosure. The architecture 130 includes source drivers 132 coupled to the active array 52. In some embodiments, the source drivers 132 corresponds to the first source drivers 106A or the second source drivers 106B discussed with respect to FIG. 8. In some embodiments, each source driver 132 corresponds to a column of pixels 67 in the active array 52. That is, the number (X) of source drivers 132 corresponds to the number of columns of pixels 67 in in the active array 52.

Each source driver 132 may include a gamma multiplexer 136 and an amplifier 138. The gamma multiplexer 136 may convert a digital data signal to a voltage to drive a respective column of pixels 67 of the active array 52. A source latch 134 is coupled to and provides an input signal to each source driver 132. A switch 140 is disposed between each source driver 132 and the active array 52. In some embodiments, each switch 140 is a multiplexer. The switches 140 are coupled to adjacent and alternating source drivers 132. That is, a first switch 140 may couple a first source driver 132 (1) and a second source driver 132 (2) adjacent to the first source driver 132 (1). A second switch 140 may couple a third source driver 132 (3) and a fourth source driver 132 (4) adjacent to the third source driver 132 (3), where the third source driver 132 (3) is also adjacent to the second source driver 132 (2).

In some embodiments, the architecture 130 includes one or more spare source drivers 144 such that the number of source drivers 132 is greater than the number of columns of pixels 67 in the active array 52. The one or more spare source drivers 144 may be used if a defective source driver 132 is identified, as discussed below. The source drivers 132 may be tested using a testing architecture such as the architecture 100 discussed with respect to FIG. 8.

Upon detection of a defective source driver 132 (e.g., through a test or calibration during manufacture or once in operation), a spare source latch 146 may be coupled to the spare source driver 144. One or more repair registers 142 may also change the state of the switches 140 depending on a location of the defective source driver 132. Although a single spare source 144 driver is illustrated to the right of the source drivers 132, it should be understood that more than one spare source driver 144 may be present and/or may be positioned between and/or to the right of the source drivers 132. Further, although a spare source driver 144 is illustrated, it should be understood that one or more spare gate drivers may be included in the gate drivers 84 discussed with respect to FIG. 7. The one or more spare gate drivers may function in a similar way to the spare source drivers 144, as discussed below.

Figure 10:
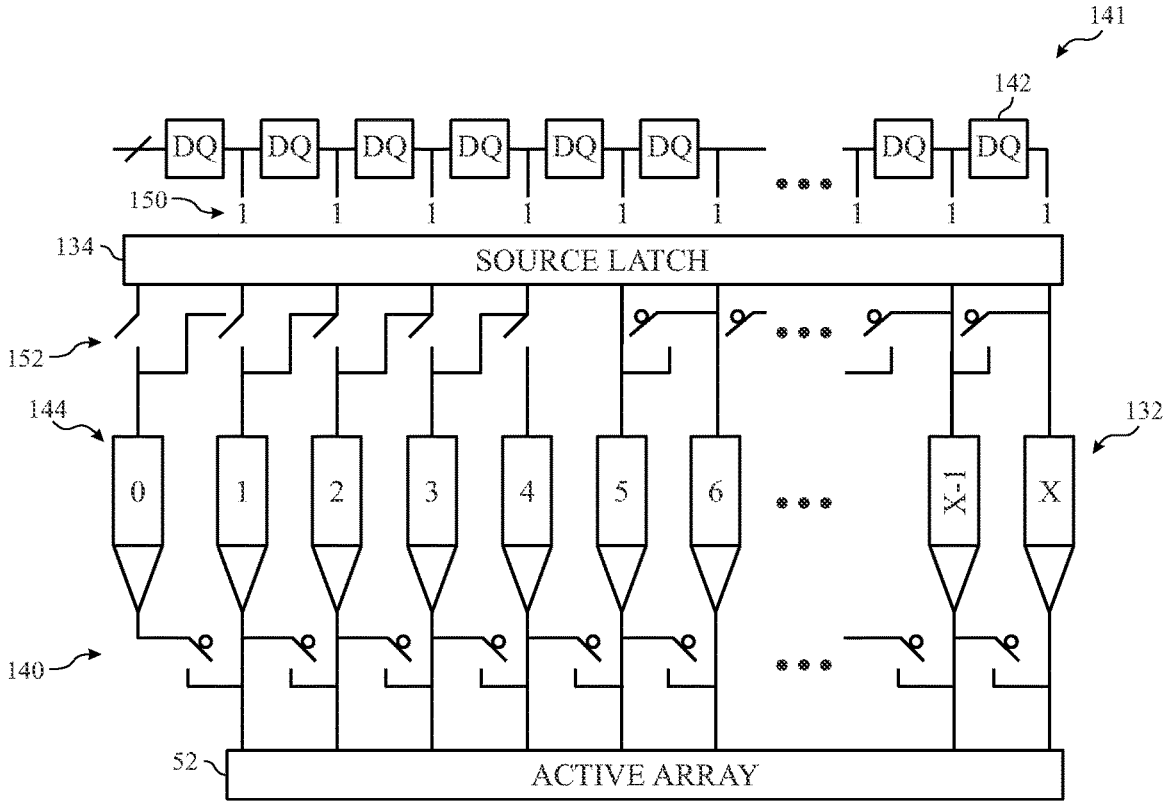
FIG. 10 is a block diagram of the example architecture for repairing a source driver of FIG. 9, according to an embodiment of the present disclosure.

FIG. 10 is a block diagram of another architecture 141 for repairing a source driver, according to an embodiment of the present disclosure. As used herein, repairing a defective source driver may involve using a spare source driver to make up for the defective source driver. The example architecture 141 in FIG. 10 illustrates the source drivers 132 coupled to the source latch 134 via one or more switches 152. The one or more switches 152 are disposed between the source latch 150 and the source drivers 132. In some embodiments, the one or more switches 152 may be multiplexers, similar to the switches 140 between the source drivers 132 and the active array 52.

In the example state illustrated in FIG. 10, an output of each repair register 142 is high (e.g., 1) such that the switches 140 pass an output of the source drivers 132 to corresponding pixels 67 in the active array 52. When a defective source driver 132 is detected, a state of one or more of the repair registers 142 may be changed along with the corresponding switches 140, as discussed with respect to FIG. 11.

Figure 11:
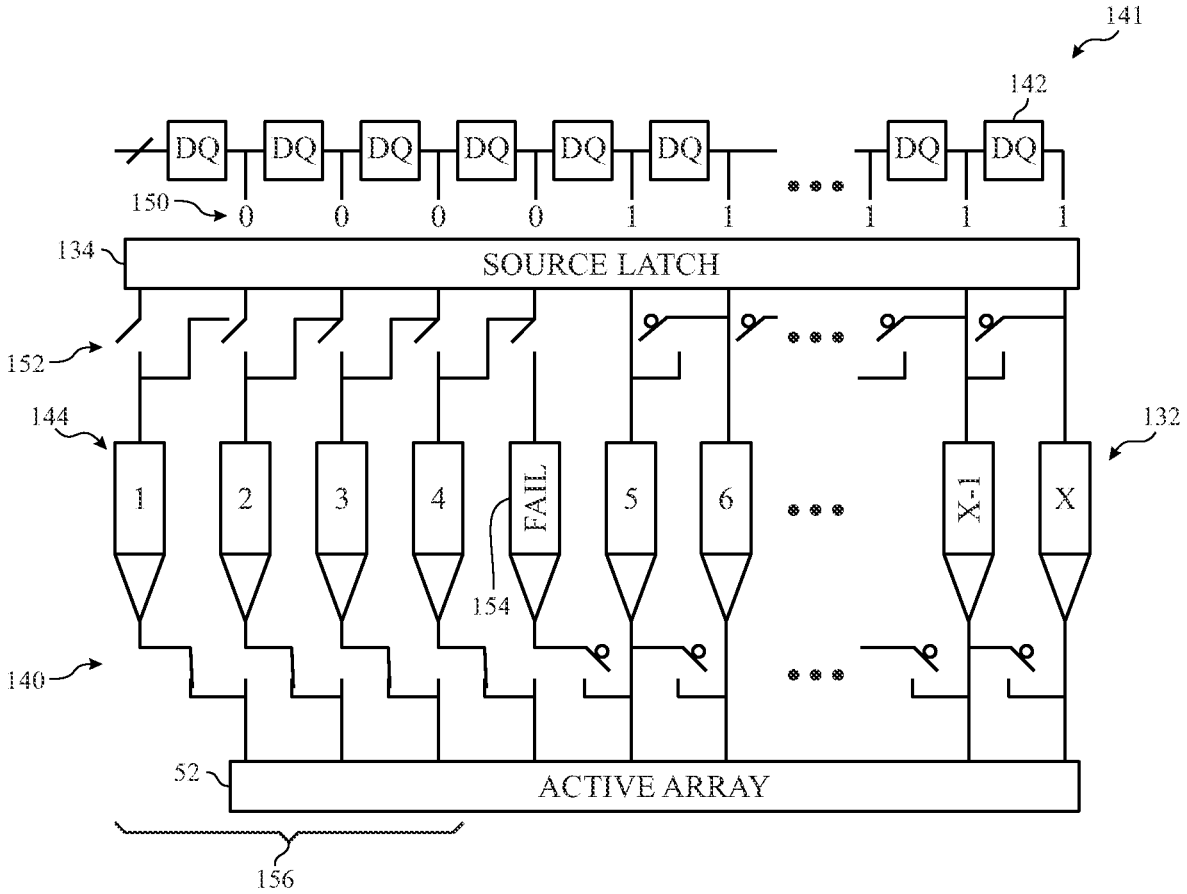
FIG. 11 is a block diagram of an example repair of a source driver using the architecture of FIGS. 9 and 10, according to an embodiment of the present disclosure.

FIG. 11 is a block diagram of an example state for repair of a source driver 132 using the architecture 141 of FIG. 10, according to an embodiment of the present disclosure. As illustrated, a defect is detected in a fourth source driver 154 (i.e., source driver number 4 illustrated in FIG. 10). Upon detecting the defect, a state of repair registers 142 corresponding to a first four source drivers 132 may be changed from high to low (e.g., 1 to 0), which causes a state of corresponding switches 140 to change. The switches 140 may change a connection of one or more of the source drivers 132 such that the one or more source drivers 132 are coupled to an adjacent column (or row) of pixels 67 in the active array 52. For example, if a defect is detected in the fourth source driver 154, a state of one or more switches 156 to the left of the fourth source driver 154 may be changed. A state of the respective switches 152 coupled to the source latch 134 may also be changed.

Changing the state of the switches 140, 152 may couple the spare source driver 144 to the first column (or row) of pixels 67 in the active array 52. Thus, the spare source driver 144 may become the first source driver illustrated in FIG. 10. Similarly, the first source driver may become the second source driver and may be coupled to the second column (or row) of pixels 67 in the active array 52. The second source driver may become the third source driver and may be coupled to the third column (or row) of pixels 67 in the active array 52. The third source driver may become the fourth source driver and may be coupled to the fourth column (or row) of pixels 67 in the active array 52.

Although a connection of the source drivers 132 to the left of the defective source driver 154 are illustrated as being coupled to an adjacent column (or row) of pixels 67, it should be understood that a similar change could occur to source drivers to the right of the defective source driver 154. Upon detection of a defective source driver, replacement of the defective source driver 154 with an adjacent source driver 132 slightly increased the routing distance between the source latch and the active array 52. Thus, a performance impact on the source drivers 132 and the spare source driver 144 may be mitigated.

In some cases, more than one defective driver may be identified during testing. In that case, a first defective source driver may be replaced as discussed above using a first spare source driver. A second defective source driver may be similarly replaced with an adjacent source driver if a second spare source driver (not shown) is present in the architecture 130. If a second spare source driver is not present, a source driver adjacent to the second defective source driver may be coupled to the column (or row) of pixels 67 corresponding to the second defective source driver. That is, the source driver adjacent to the second defective source driver may be used to drive two columns (or rows) of pixels 67, namely (1) the pixels corresponding to the adjacent source driver after the first defective source driver is replaced and (2) the pixels corresponding to the second defective source driver.

Accordingly, the embodiments discussed with respect to FIGS. 9-11 reduce a time to detect and replace a defective source driver while mitigating an impact on a performance of the remaining source drivers and mitigating an impact on a number of components added to the display architecture to perform the testing.

Figure 12:
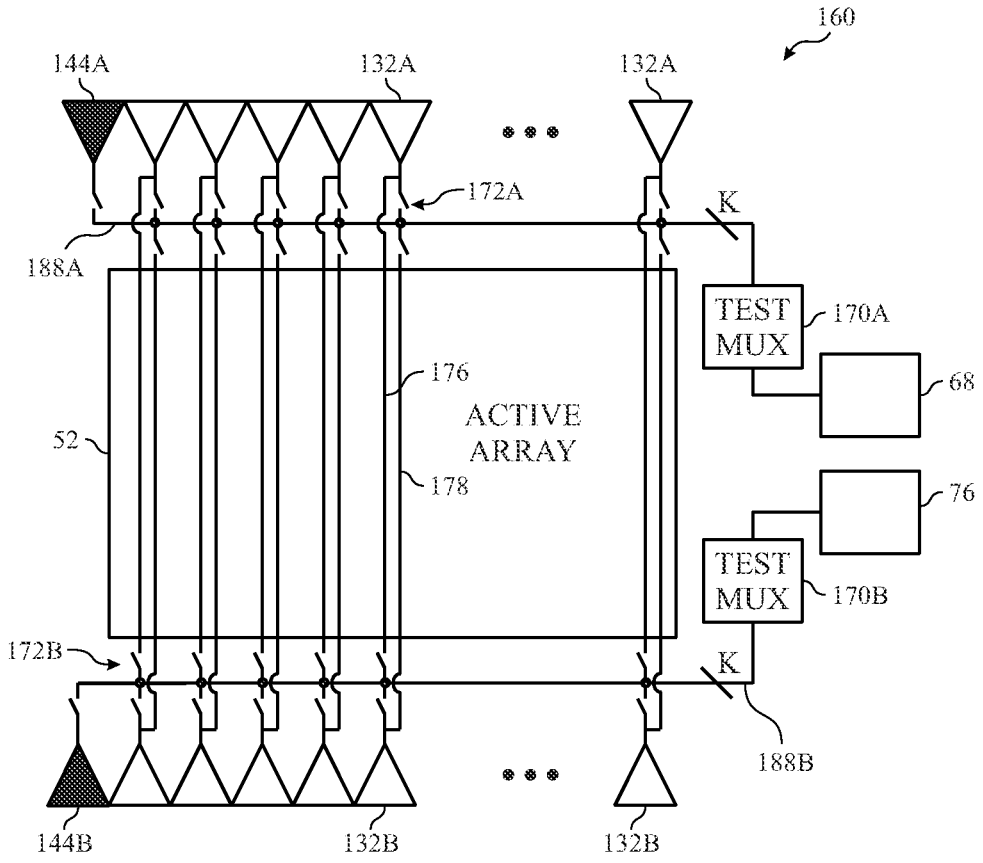
FIG. 12 is a block diagram of an example architecture for repairing a data line using a repair bus, according to an embodiment of the present disclosure.

FIG. 12 is a block diagram of an example architecture 160 for repairing a data line using a repair bus, according to an embodiment of the present disclosure. The architecture 160 may be used in concert with the testing architecture 100 discussed with respect to FIG. 8 to test pluralities of source drivers 132A, 132B. In some embodiments, pluralities of source drivers 132A, 132B may correspond to the source drivers 58A, 58B, discussed with respect to FIG. 7, respectively. Each of the pluralities of source drivers 132A, 132B include a spare source driver 144A, 144B, respectively. The architecture 160 includes one or more first switches 172A and one or more second switches 172B opposite the one or more first switches 172A. The architecture 160 also includes testing multiplexers 107A, 170B coupled to the first switches 172A and the second switches 172B, respectively. The testing multiplexers 107A, 170B are coupled to the test circuitry 68, 76.

The first switches 172A are disposed between the source drivers 132A and a first repair bus 188A. The second switches 172B are disposed between the source drivers 132B and a second repair bus 188B. The first switches 172A control whether the source drivers 132A are coupled to respective data lines 178 and/or a testing multiplexer 170A and test circuitry 68. Similarly, the second switches 172B control whether the source drivers 132B are coupled to respective data lines 176 and/or the testing multiplexer 170B and the test circuitry 76.

The test circuitry 68, 76 may be used to identify a defective data lines 176, 178 coupled to the respective source drivers 132A, 132B. For example, if a defect in the architecture 160 is identified via the test circuitry, but each of the source drivers 132A, 132B is operating properly, a defect is likely present in a data line 176, 178 (or a switch 172A, 172B). In that case, a state of the switches 172A, 172B is changed such that a spare source driver 144A, 144B is coupled to a first portion of the defective data line 176, 178. Similarly, a state of the switches is changed such that the source driver coupled to the defective data line 176, 178 from the source driver 132A, 132B originally coupled to the defective data line 176, 178 is replicated and provided to the spare source driver 144A, 144B now connected to the defective data line 176, 178.

Figure 13:
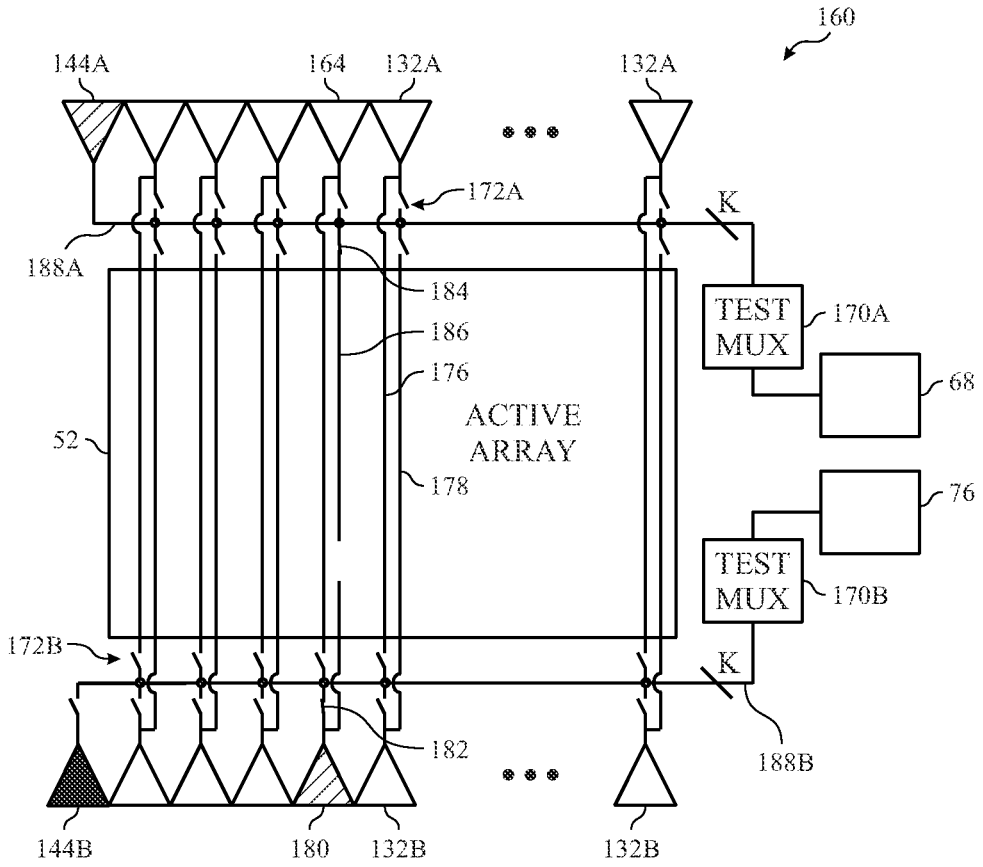
FIG. 13 is a block diagram of an example repair of a data line using a repair bus, according to an embodiment of the present disclosure.

FIG. 13 is a block diagram of an example repair of a data line using the architecture 160 discussed with respect to FIG. 12, according to an embodiment of the present disclosure. Upon detecting a defect in a fourth data line 186 coupled to a source driver 132A, a state of a respective switch 184 is changed to couple a first portion of the defective data line 186 to the repair bus 188A. Similarly, a state of a respective switch 182 is changed to couple a second portion of the defective data line 186 to the repair bus 188B. The first portion of the defective data line 186 is driven via the spare source driver 144A and the second source driver is driven via the respective source driver 180. Depending on a location of the pixel 67 coupled to the defective data line 186, the first portion of the defective data line 186 may be driven via the respective source driver 164 and the second portion of the defective data line may be driven via the spare source driver 144B. The test circuitry 68, 76 may be used to identify which source driver 132A, 132B, 144A, 144B is used to drive a particular portion of the defective data line 186.

In some embodiments, the architecture 160 may be used to repair a defective source driver 132A, 132B. For example, if the fourth source driver 164 is identified as defective, the spare source driver 144A may be coupled to the respective data line 186 via the respective switch 184. In this way, the remaining source drivers 132A, 132B remain coupled to the respective data lines 176, 178 and only the defective source driver 164 is replaced via the spare source driver 144A.

Using the repair buses 188A, 188B to repair a defective data line 176, 178 and/or a defective source driver 132A, 132B reduces a time period between detection and correction. Further, the repair buses 188A, 188B and the switches 172A, 172B have a relatively small impact on power consumption for performing the repair and a relatively small impact on the size of the architecture 160 within the system 50.

Figure 14:
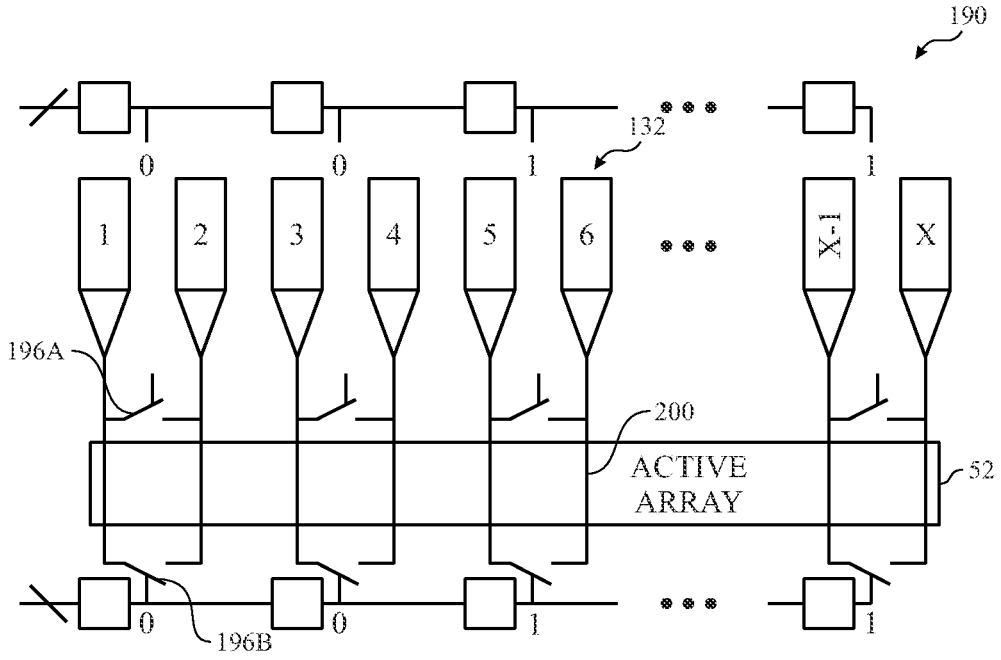
FIG. 14 is a block diagram of an example architecture for repairing a data line, according to an embodiment of the present disclosure.

FIG. 14 is a block diagram of an example architecture 190 for repairing a data line, according to an embodiment of the present disclosure. The architecture 190 includes a number of switches 196A, 196B disposed between and coupled to an output of adjacent source drivers 132A. That is, the switches 196 are coupled to at least one data line 200 and may couple to an adjacent data line 200 when in a closed state. In some embodiments, the switches 196 may be implemented using a number of multiplexers disposed between and coupled to outputs of the adjacent source drivers 132A. While the switches 196 are illustrated as disposed between the source drivers 132A and the active array 52, it should be understood that additional switches (not shown) could be disposed between the active array 52 and the source drivers 132B discussed with respect to FIGS. 12 and 13.

During normal operation, as illustrated in FIG. 14, the switches 196 are in an open state such that the outputs of adjacent source drivers 132A are not connected. Upon detection of a defective data line 200, as discussed with respect to FIGS. 10 and 11, a state of the switches 196A, 196B between the defective data line 200 and an adjacent data line 200 may be changed such that the defective data line 200 and the adjacent data line 200 are coupled together.

Figure 15:
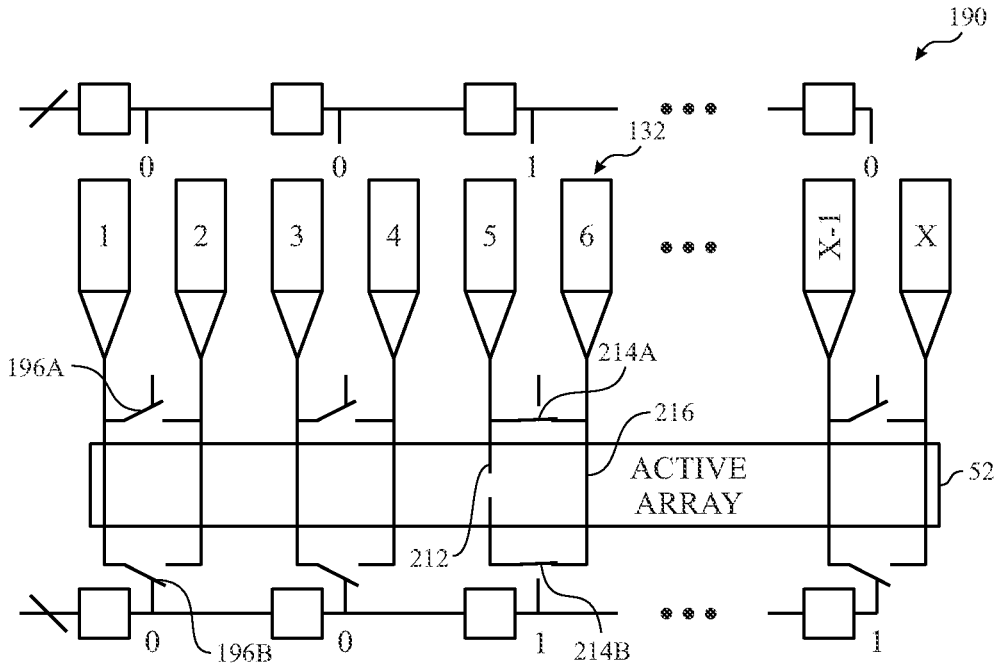
FIG. 15 is a block diagram of an example repair of a data line using replication, according to an embodiment of the present disclosure.

FIG. 15 is a block diagram of an example repair of a data line using the architecture 190 discussed with respect to FIG. 14, according to an embodiment of the present disclosure. As illustrated, a defective data line 212 may be detected using the test circuitry 68, 76 as discussed with respect to FIGS. 7-12. Once the defective data line 212 is detected, a state of respective switches 214A and 214B may be changed so that the defective data line 212 is coupled to an adjacent data line 216. As illustrated, each end of the defective data line 212 is coupled to the adjacent data line 216 so that a location of the corresponding pixel 67 of the active array 52 on the defective data line 212 does not affect an operation thereof.

The architecture 190 may also be used to repair a defective source driver 132A. For example, if a defective source driver 132A is identified via the test circuitry 68, 76, the defective source driver 132A is replaced by an adjacent source driver 132A by coupling the data line 200 corresponding to the defective source driver 132A to the adjacent source driver 132A via the switches 196A, 196B.

Testing and repairing a defective data line (and/or a defective source driver) in this way duplicates a signal or data on an adjacent data line. Accordingly, the switches 196A, 196B add a relatively small number of components to the architecture of the display 18 while reducing a time to test the architecture of the display 18 and reducing an impact on performance of the source drivers 132A and the system 50.

Figure 16:
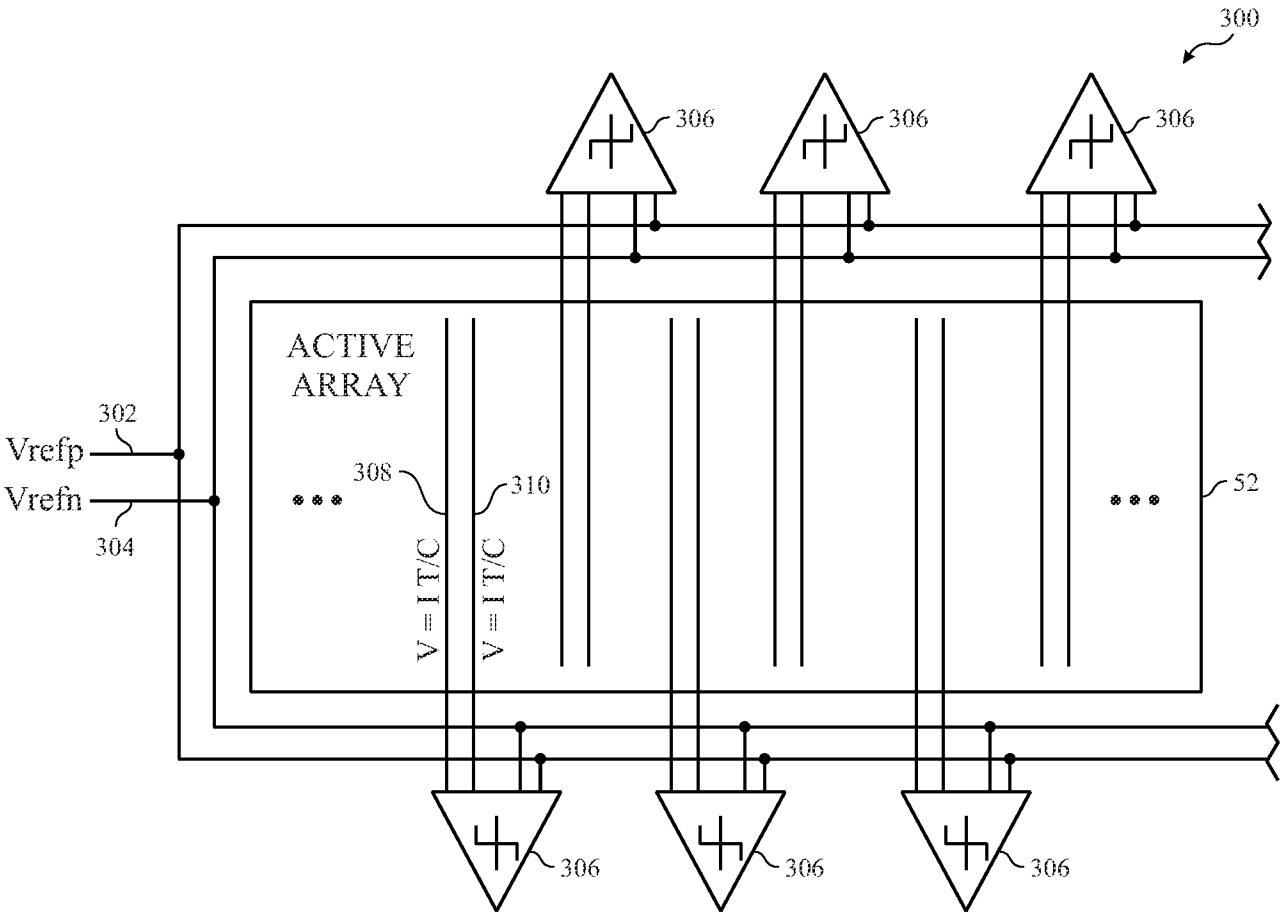
FIG. 16 is a block diagram of an example architecture for fast detection of a defective pixel, according to an embodiment of the present disclosure.

FIG. 16 is a block diagram of an example architecture 300 for fast detection of a defective pixel driver, according to an embodiment of the present disclosure. The architecture 300 includes a number of comparators 306. The comparators 306 are coupled to one or more pixel circuitries of the active array 52, such as the pixel circuitries 64 discussed with respect to FIG. 7. The comparators 306 receive and compare a voltage provided to the corresponding one or more pixel circuitries 64 (or pixels 67) via source drivers, such as the source drivers 58A, 58B, 106A, 106B, 132A, 132B discussed above, and one or more reference voltages 302, 304. The voltage provided to the pixel circuitries 64 (or pixels 67) may be determined by sensing and converting a current through the pixel circuitries 64 (or pixels 67).

The reference voltages 302, 304 are programmable and may be set to a threshold voltage to identify a defective pixel circuitry 64 (or pixel 67) by determining whether the voltage from the pixel circuitry 64 satisfies the reference voltages 302, 304. The reference voltages 302, 304 are used by the comparators to determine if a current of a source driver, such as the source drivers 58A, 58B, 106A, 106B, 132A, 132B discussed above, is relatively small or large compared to the reference voltages 302, 304. The current from the source drivers may be converted to a voltage by integrating the current onto a parasitic capacitance and comparing the voltage to the reference voltages 302, 304. If the voltage of a particular source driver is larger than the threshold voltage, that source driver may be understood to be a defective bright source driver. Similarly, if the voltage of the particular source driver is smaller than the threshold voltage, that source driver may be understood to be a defective dark source driver. The reference voltages 302, 304 may be programmed differently to detect defective bright source drivers and defective dark source drivers. For example, to detect defective bright source drivers, the threshold voltage may be programmed to be relatively small. To detect defective dark source drivers, the threshold voltage may be programmed to be relatively high. Once a defective source driver is identified, any suitable search (e.g., a binary search) of a corresponding column of pixels may be used to identify a row of the active array 52 in which a defective pixel resides.

In some embodiments, the comparators 306 are coupled to more than one column of pixels 67 and corresponding pixel circuitry 64 of the active array 52. Coupling more than one column to the comparators 306 reduces a number of comparators 306 to test all columns of the active array 52 and significantly reduces a time to test each column of pixels 67 in the active array 52. For example, each comparator 306 may be coupled to six columns of pixels 67. In that case, one sixth (⅙) of the columns in the active array 52 can be tested simultaneously. Accordingly, the comparators 306 coupled to a number of columns of the active array 52 significantly reduces a time and cost to test each column of the active array 52.

Figure 17:
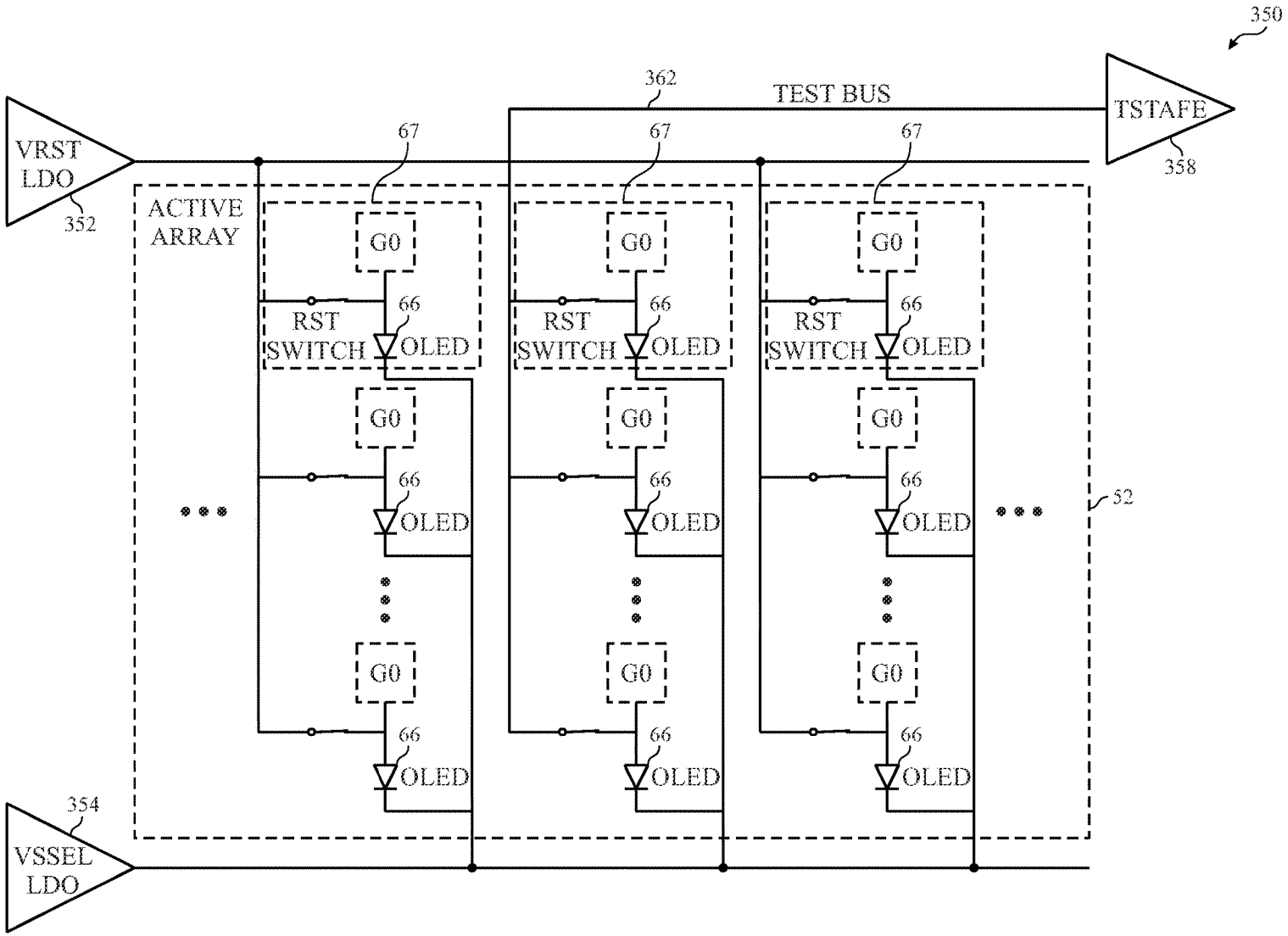
FIG. 17 is a block diagram of an example architecture of an on-chip IV sensing system, according to an embodiment of the present disclosure.

FIG. 17 is a block diagram of an example architecture 350 of an on-chip IV sensing system, according to an embodiment of the present disclosure. Pixel degradation of each pixel circuitry 64 or OLED 66 may occur as each pixel circuitry 64 or OLED 66 in the active array 52 ages. On-chip IV sensing via a current sensor 358 enables near real-time sensing and performance tracking of each pixel circuitry 64 or OLED 66. The current sensor 358 may be coupled to the output of each OLED 66 via a test bus 362.

In some embodiments, the current sensor 358 may be used to test an aggregate current of all OLEDs 66 in the active array 52. In addition or in the alternative, the current sensor 358 may be used to sense a current through each individual OLED 66 and/or any combination of pixels 67 in the active array. To do so, an anode of each OLED 66 is coupled to the test bus 362. A voltage of a cathode of each OLED 66 is provided as an input voltage 354 to the active array 52. A difference between the voltage at the cathode of each OLED 66 and the voltage at the anode of each OLED 66 may be used to generate a current-voltage (IV) curve for each OLED 66 or any combination of pixels 67 in the active array 52. The IV curve for each OLED 66 may be used to determine and correct voltage and/or current degradation of each OLED 66.

The current sensor 358 enables fast current and/or voltage sensing of each pixel 67 individually and any combination of pixels 67. Further, the current sensor 358 enables testing of all pixels 67 in the active array 52. Using the IV curve generated based on sensing by the current sensor 358 enables compensation for pixel degradation which improves a quality of the active array 52 and extends a life of the active array 52.

Figure 18:
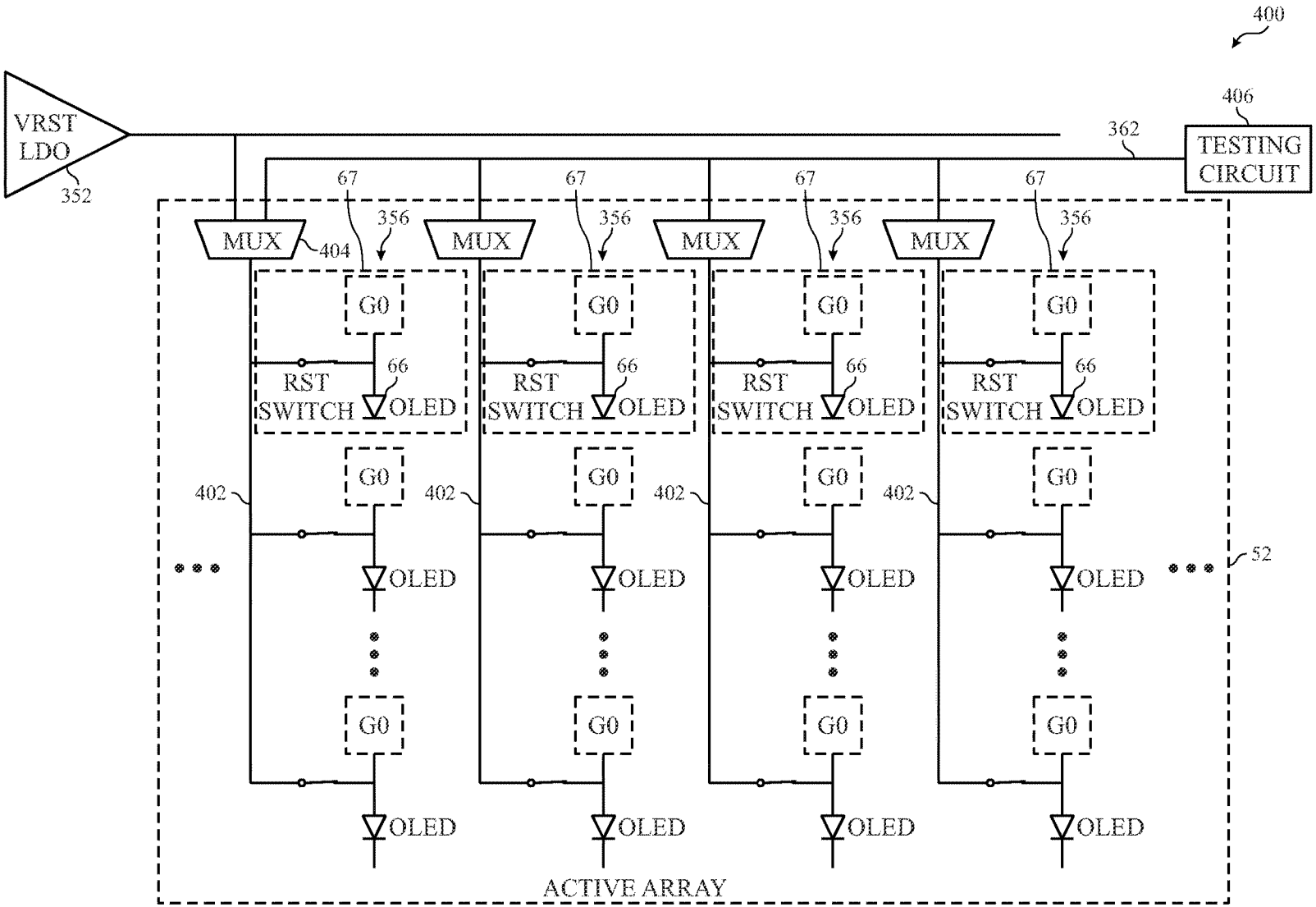
FIG. 18 is a block diagram of an example architecture for a test bus discussed with respect to FIG. 17, according to an embodiment of the present disclosure.

FIG. 18 is a block diagram of an example architecture 400 for the test bus 362 discussed with respect to FIG. 17, according to an embodiment of the present disclosure. The test bus 362 illustrated in FIG. 18 may correspond to the test bus discussed with respect to FIG. 17. As illustrated, the test bus 362 is coupled to a multiplexer 404 for each column 356 of the active array 52. An input 352 is also coupled to the multiplexers 404. In some embodiments, an input voltage may be coupled to a cathode of each OLED 66, such as the input voltage 354 discussed with respect to FIG. 17.

In some embodiments, the multiplexers 404 may be implemented as switches. The multiplexers 404 are coupled to each pixel 67 via a data line 402. In the architecture 400, the data lines 402 may serve a dual purpose. For example, during a test operation, the data lines 402 may be used to test a voltage and/or current of each pixel 67. In that case, the data lines 402 may be coupled to the test bus 362 via the multiplexers 404. During normal operation, the data lines 402 may provide a voltage to the pixels 67, such as VRST via the input 352. In that case, the data lines 402 may be coupled to the input 352 via the multiplexers 404.

The dual usage of the data lines 402 eliminates an addition of a separate testing line from the test bus 362 to each pixel 67. That is, the dual usage of the data lines 402 in combination with the multiplexers 404 and the test bus 362 enables testing of each pixel 67 without using a large amount of the display area. Thus, more area is available in the architecture 400 for additional pixels that can be used to increase a higher resolution of the active array 52.

Figure 19:
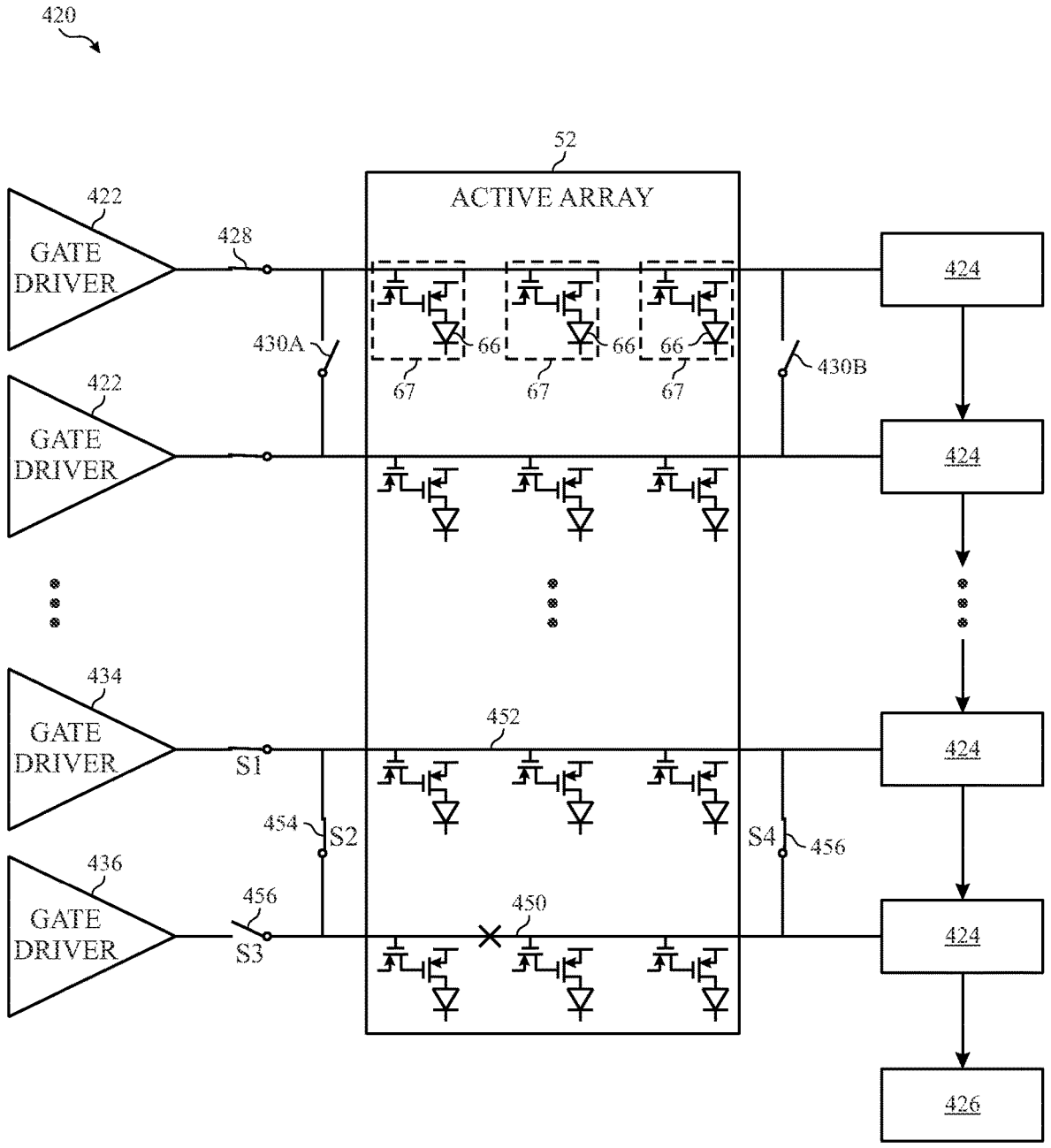
FIG. 19 is a block diagram of an example architecture for repairing a gate driver and/or gate driver line data line, according to an embodiment of the present disclosure.

FIG. 19 is a block diagram of an example architecture 420 for repairing a gate driver 422, 434, 436 and/or gate driver data line 452, according to an embodiment of the present disclosure. The architecture 420 may be used in addition to or alternative to the architectures 100, 130, 160, 190, 300, 350, and 400 discussed with respect to FIGS. 8-18. The architecture 420 includes one or more switches 430A, 430B between adjacent gate driver data lines 452. The gate driver data lines 452 are coupled to a gate driver 422 and a shift register 424. The shift registers 424 may be coupled to a test circuitry 426. The shift registers 424 may collect data in parallel and shift the data serially from shift register 424 to shift register 424 into the test circuitry 426.

The architecture 420 may also include a switch 428 between the gate drivers 422 and the active array 52. During normal operation, the switches 430A, 430B are in an open state and the switches 428 are in a closed state. Thus, a signal from each gate driver 422 is provided along a respective gate driver data line 452 to respective rows of pixels 67 of the active array 52 and to a respective shift register 424.

The test circuitry 426 receives the signals from each shift register 424 and may identify one or more defective gate drivers 422 and/or gate driver data lines 452 based on the received signals. For example, a particular gate driver 422 and/or corresponding gate driver data line 452 may be identified as defective if a signal is not received from the particular gate driver 422 and/or corresponding data line 432. Whether the particular gate driver 422 or corresponding gate driver data line 452 are actually defective, a state of the switch 428 coupling that gate driver 422 to the active array is changed to open. Thus, the gate driver 422 identified as defective or coupled to a defective data line 450 is decoupled from the active array 52. The states of the switches 430A, 430B are also changed such that the gate driver data line 452 corresponding to the decoupled gate driver 422 is coupled to an adjacent gate driver 422 and corresponding gate driver data line 452. Thus, the gate driver data line 452 corresponding to the defective gate driver 422 (or the defective data line 450) is coupled to the adjacent gate driver 422 and corresponding gate driver data line 452.

As an example, the test circuitry 426 may determine that the data line 450 is defective. In that case, a state of a switch 456 disposed between the gate driver 436 corresponding to the defective data line 450 and the active array 52 is changed to open. Thus, the gate driver 436 is decoupled from the active array 52. A state of switches 454 and 456 is changed to closed, such that the defective data line 450 is coupled to the adjacent data line 452. The same procedure may be used if the gate driver 436 were defective.

The architecture 420 enables repair of a gate driver and/or data line using an adjacent gate driver and data line. A data signal provided to the adjacent data line is thus replication on the defective data line. This approach enables a relatively fast repair of a defective gate driver and/or data line while reducing a size impact of the architecture 420. That is, relatively few components are added to the architecture to enable adjacent line replication. For example, to enable adjacent line replication, as few as four switches may be added for every two data lines.

While some embodiments discussed above relate to testing, detection, and repair of source drivers and corresponding data lines, it should be understood that the same circuitry and techniques can be used to test, detect, and repair gate drivers and corresponding data lines. That is, the embodiments described herein may be used to test, detect, and repair vertical and/or horizontal drivers and data lines of an electronic display. Further, it should be noted that the testing, detection, and repair of drivers and corresponding data lines described herein can be performed with or without the light-emitting diodes (e.g., LEDs and/or OLEDs 66) installed in the active array 52.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An electronic display comprising:

an active array comprising a pixel circuit;

a source driver configured to be coupled to and provide a voltage to the pixel circuit; and a comparator coupled to the pixel circuit and configured to receive a reference voltage and the voltage from the pixel circuit, wherein the reference voltage comprises a threshold voltage for the pixel circuit, and wherein the comparator is configured to identify a defective source driver.

2. The electronic display of claim 1, wherein the voltage provided to the pixel circuit is determined based at least in part on a current through the pixel circuit.

3. The electronic display of claim 2, wherein the defective source driver is identified by converting the current through the pixel circuit into a voltage by integrating the current onto a parasitic capacitance and comparing the voltage to the reference voltage.

4. The electronic display of claim 1, comprising:

test circuitry coupled to the comparator, wherein the test circuitry is configured to classify at least a first pixel circuit of a plurality of pixel circuits as a type of defective pixel circuitry using an output of the comparator.

5. The electronic display of claim 4, wherein the test circuitry is configured to classify at least the first pixel circuit of the plurality of pixel circuits as a dark pixel circuit upon determining that a voltage of the first pixel circuit fails to satisfy the threshold voltage and classifies at least the first pixel circuit as a bright pixel circuit upon determining voltage of the first pixel circuit satisfies the threshold voltage.

6. The electronic display of claim 1, wherein the pixel circuit is disposed in columns and the comparator is coupled to at least three columns.

7. The electronic display of claim 6, wherein the comparator is configured to test at least one column simultaneously.

8. An electronic display comprising:

an active array comprising a pixel circuit coupled to a light-emitting diode (LED);

a data line coupled to the pixel circuit;

a test bus configured to be coupled to an anode of the LED and configured to receive a voltage at a cathode of the LED as input voltage; and test circuitry coupled to the test bus and configured to determine that the LED is defective based on a comparison of a voltage at the anode and the voltage at the cathode.

9. The electronic display of claim 8, further comprising:

current-voltage sensing circuitry coupled to the test bus and configured to generate a current-voltage curve for the pixel circuit.

10. The electronic display of claim 9, wherein the current-voltage sensing circuitry is configured to sense an aggregate current of the pixel circuit.

11. The electronic display of claim 8, comprising:

a switch configured to couple the data line to one of the test bus and an input line.

12. The electronic display of claim 11, wherein the data line is coupled to the test bus via the switch for testing a column of pixel circuitries via the test circuitry.

13. The electronic display of claim 12, wherein data line is decoupled from the input line.

14. The electronic display of claim 12, wherein the data line is configured to provide a current to the pixel circuit via the input line and the switch when the data line is not being tested.

15. An electronic display comprising:

an active array comprising a plurality of pixel circuitries arranged in rows, each row coupled to a data line;

a plurality of gate drivers;

a first plurality of switches configured to couple the plurality of gate drivers to respective data lines;

a second plurality of switches configured to couple data lines of adjacent gate drivers;

a third plurality of switches opposite the second plurality of switches and configured to couple data lines of adjacent gate drivers; and test circuitry configured to identify a defective gate driver, a defective pixel circuitry, or a defective data line, or any combination thereof.

16. The electronic display of claim 15, wherein the second plurality of switches and the third plurality of switches are disposed on opposite sides of the active array.

17. The electronic display of claim 15, wherein, upon identifying a defective gate driver, a respective first switch of the of the first plurality of switches is configured to open to decouple the defective gate driver from the respective data line.

18. The electronic display of claim 17, wherein a second switch of the second plurality of switches and a third switch of the third plurality of switches are configured to close to couple the respective data line to an adjacent data line.

19. The electronic display of claim 15, wherein, upon identifying a defective data line, a respective first switch of the first plurality of switches and a respective second switch of the second plurality of switches are configured to close to couple the defective data line to an adjacent data line.

20. The electronic display of claim 19, wherein the respective first switch couples a first portion of the defective data line to the adjacent data line and the respective second switch couples a second portion of the defective data line to the adjacent data line.

* * * * *